US008403651B2

(12) United States Patent
Hsu et al.

(10) Patent No.: US 8,403,651 B2
(45) Date of Patent: Mar. 26, 2013

(54) FAN AND AIRFLOW GUIDING STRUCTURE THEREOF

(75) Inventors: Chia-Ming Hsu, Taoyuan Hsien (TW); Shun-Chen Chang, Taoyuan Hsien (TW); Li-Chen Lin, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 503 days.

(21) Appl. No.: 12/429,761

(22) Filed: Apr. 24, 2009

(65) Prior Publication Data

US 2009/0269195 A1 Oct. 29, 2009

(30) Foreign Application Priority Data

Apr. 25, 2008 (TW) ..... 97115310 A
Mar. 11, 2009 (TW) ..... 98107835 A
Mar. 11, 2009 (TW) ..... 98107836 A

(51) Int. Cl.
*F04B 35/04* (2006.01)

(52) U.S. Cl. ..... 417/423.1

(58) Field of Classification Search ..... 417/423.1, 417/423.14, 424.1; D24/411
See application file for complete search history.

(56) References Cited

U.S. PATENT DOCUMENTS 5,730,583 A * 3/1998 Alizadeh ..... 416/189
6,196,300 B1 * 3/2001 Checchetti ..... 165/80.3
2006/0228237 A1 * 10/2006 Winkler ..... 417/423.1
2007/0080604 A1 4/2007 Yang et al.
2008/0075585 A1 * 3/2008 Acre ..... 415/177
2010/0232957 A1 * 9/2010 Horng ..... 415/208.1

FOREIGN PATENT DOCUMENTS

CN 2406092 Y 11/2000
CN 1793665 A1 6/2006
JP 2001-140798 5/2001
JP 2002-257095 9/2002

* cited by examiner

*Primary Examiner* — Anh Mai
*Assistant Examiner* — Michael Santonocito
(74) *Attorney, Agent, or Firm* — Muncy, Geissler, Olds & Lowe, PLLC

(57) ABSTRACT

A fan includes an airflow guiding structure, an impeller and a guiding ring. The outer radius of the airflow guiding structure increases gradually from the top to the bottom of the airflow guiding structure. The airflow guiding structure includes a plurality of fins and a first space for accommodating a circuit device. The impeller is disposed on the airflow guiding structure and the impeller has a hub and several axial-flow blades disposed around the hub. The guiding ring is connected with the axial-flow blades. An inlet is formed on the top of the guiding ring, and an outlet is formed between the bottom of the guiding ring and the outer surface of the sidewall of the airflow guiding structure. When the impeller rotates, the airflow enters the fan from the inlet and flows along the outer surface of the sidewall of the airflow guiding structure, then the airflow exits the fan through the outlet. The direction of the airflow passing through the outlet is different from the direction of the airflow passing through the inlet.

17 Claims, 12 Drawing Sheets

FAN AND AIRFLOW GUIDING STRUCTURE THEREOF

CROSS REFERENCE TO RELATED APPLICATIONS

This Non-provisional application claims priorities under 35 U.S.C. §119(a) on Patent Application No(s). 097115310, filed in Taiwan, Republic of China on Apr. 25, 2008, Patent Application No(s). 098107835, filed in Taiwan, Republic of China on Mar. 11, 2009, and Patent Application No(s). 098107836, filed in Taiwan, Republic of China on Mar. 11, 2009, the entire contents of which are hereby incorporated by reference.

BACKGROUND OF THE INVENTION

1. Field of Invention

The present invention relates to a fan and in particular to a fan and an airflow guiding structure thereof that can change the direction of the airflows of the fan.

2. Related Art

Since the performance of the electronic apparatuses has been improved, the heat dissipation device or system becomes one of the indispensable equipments of the electronic apparatuses. If the heats generated by the electronic apparatus can not be dissipated properly, the performance thereof may become worse and, even more the electronic apparatus may be burnt out. As for the micro electronic devices such as the integrated circuits (ICs), the dissipation device is much more important. In view of the integrated density of the ICs being increasing and the progress of the packaging technology, the size of the ICs becomes smaller, and the heat accumulated in per unit area of the integrated circuits become higher. Therefore, a heat dissipation device with high heat dissipation efficiency has become one of the most important development areas in the electronic industry.

Fan is the most popular heat dissipation device in the present heat dissipation technology. According to the directions of the airflow entering and exiting from the fan, the fan can be classified to axial-flow fans and centrifugal fans. In an axial-flow fan, the airflow enters the conventional axial-flow fan through the inlet and then exits through the outlet. The airflow direction entering into the inlet is roughly parallel to the airflow direction exiting from the outlet. On the other hand, in a centrifugal fan, the airflow enters the conventional centrifugal fan through the inlet and then exits through the outlet. The airflow direction entering into the inlet is roughly perpendicular to the airflow direction exiting from the outlet. Compared to the axial-flow fan, although the centrifugal fan can change the airflow direction, the centrifugal fan has the drawbacks of lower performance, lower airflow quantity and louder noise. Moreover, the centrifugal fan is hard to provide a multi-function fan in the current trend towards small size.

SUMMARY OF THE INVENTION

The present invention is to provide a fan and an airflow guiding structure thereof that can change the airflow direction of the conventional axial-flow fan as well as keeping the advantages of the conventional axial-flow fan such as high performance, large air quantity and low noise.

Furthermore, the present invention is to provide a fan and an airflow guiding structure thereof that can conduct heats away from a heat source by a plurality of fins of the airflow guiding structure, so as to enhance the heat dissipating efficiency of the fan.

Moreover, the present invention is to provide a fan and an airflow guiding structure thereof that has a first space for accommodating an exterior circuit device so as to economize the use of space, and the circuit device can be protected under the airflow guiding structure.

To achieve the above, the present invention discloses a fan including an airflow guiding structure, an impeller and a guiding ring. An outer radius of the airflow guiding structure increases gradually from the top of the airflow guiding structure to the bottom of the airflow guiding structure. The impeller is disposed on the airflow guiding structure and the impeller has a hub and a plurality of axial-flow blades disposed around the hub. The guiding ring is connected with the axial-flow blades. An inlet is formed on the top of the guiding ring, and an outlet is formed between the bottom of the guiding ring and an outer surface of the sidewall of the airflow guiding structure. When the impeller rotates, the airflow enters the fan from the inlet and flows along the outer surface of the sidewall of the airflow guiding structure, then the airflow exits the fan through the outlet. The direction of the airflow passing through the outlet is different from the direction of the airflow passing through the inlet. Furthermore, the airflow guiding structure is composed of a plurality of fins, and a first space is disposed in the airflow guiding structure for accommodating a circuit device.

To achieve the above, the present invention also discloses an airflow guiding structure applied to an axial-flow fan. The axial-flow fan includes an impeller and a guiding ring. The impeller has a hub and a plurality of axial-flow blades disposed around the hub. The guiding ring is connected with the axial-flow blades. The airflow guiding structure is disposed underneath the impeller. An outer radius of the airflow guiding structure increases gradually from the top of the airflow guiding structure to the bottom of the airflow guiding structure. An inlet is formed on the top of the guiding ring, and an outlet is formed between the bottom of the guiding ring and an outer surface of the sidewall of the airflow guiding structure. When the impeller rotates, the airflow enters the fan from the inlet and flows along the outer surface of the sidewall of the airflow guiding structure, then the airflow exits the fan through the outlet. The direction of the airflow passing through the outlet is different from the direction of the airflow passing through the inlet.

In addition, the present invention further discloses an airflow guiding structure, which is disposed under an outlet of an axial-flow fan. An inlet of the axial-flow fan is arranged over the outlet of the axial-flow fan. An outer radius of the airflow guiding structure increases gradually from the top of the airflow guiding structure to the bottom of the airflow guiding structure, thereby changing an direction of the airflow exiting from the outlet of the axial-flow fan.

As mentioned above, in the fan and airflow guiding structure of the present invention, the outer radius of the airflow guiding structure increases gradually from the top of the airflow guiding structure to the bottom of the airflow guiding structure. Thus, the direction of the airflow can be changed when the airflow flows along the outer surface of the sidewall of the airflow guiding structure and then exits the fan. Furthermore, the airflow guiding structure is composed of a plurality of fins, and a first space is disposed in the airflow guiding structure for accommodating a circuit device. Compared with the prior art, the present invention can not only change the direction of the airflow exiting from the fan, but also keeps the advantages of high performance, large quantity of exiting airflow and low noise. Moreover, the present invention enhances the heat dissipating efficiency of the fan and economizes the use of space by the structure of the airflow guiding structure.

BRIEF DESCRIPTION OF THE DRAWINGS

The present invention will be fully understood from the subsequent detailed description and accompanying drawings, which are given by way of illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1A:
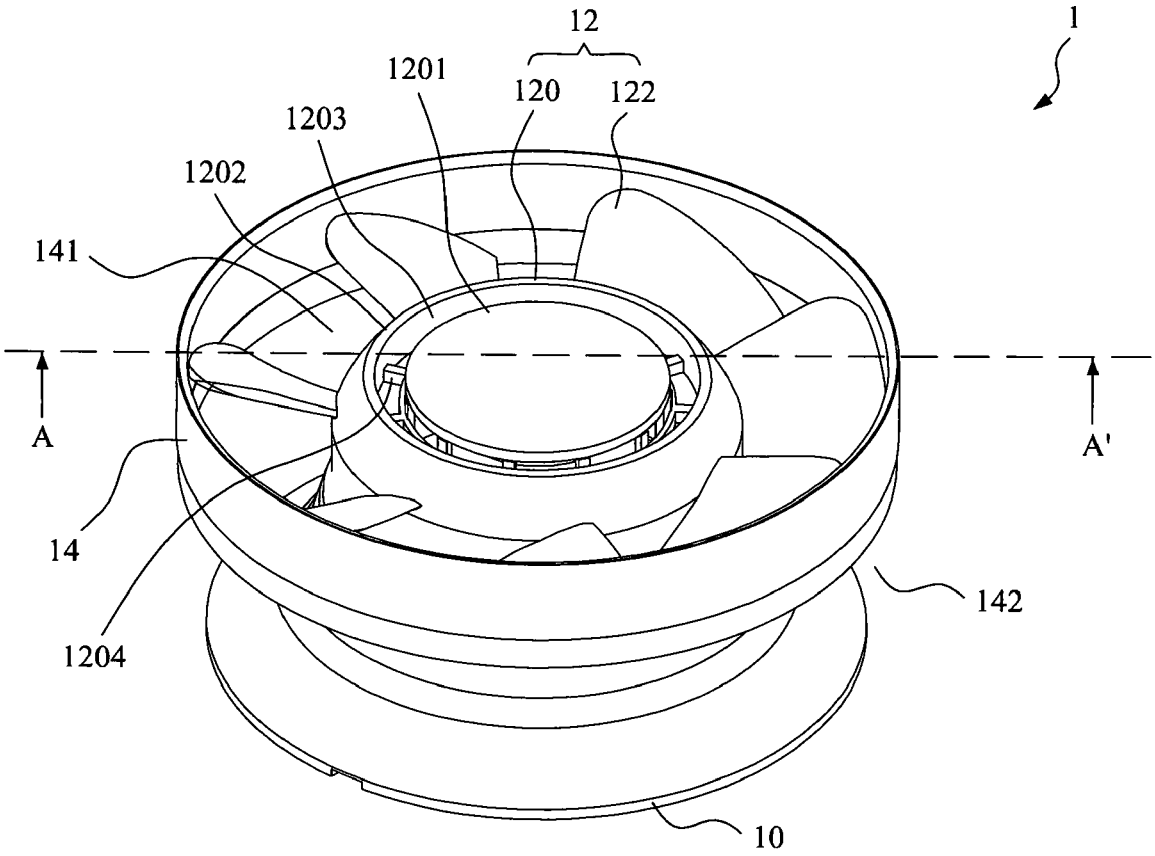
FIG. 1A is a three-dimensional illustration showing a fan according to a first embodiment of the present invention.
Figure 1B:
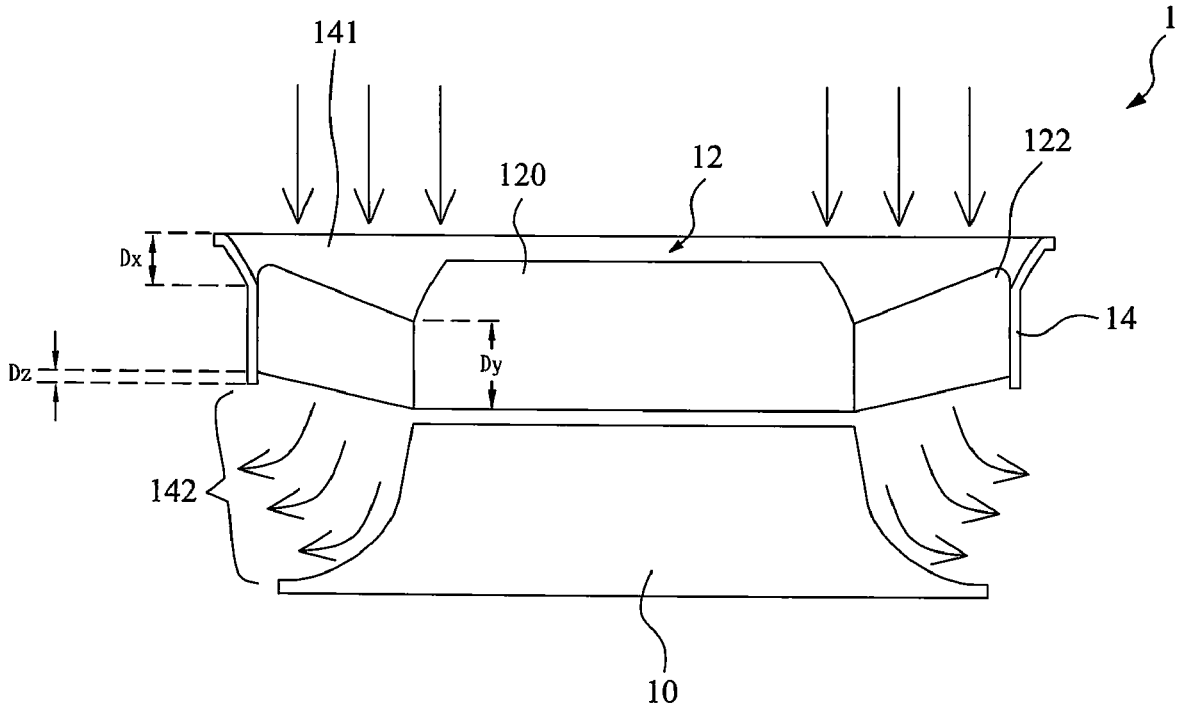
FIG. 1B is a sectional view of the fan along line A-A' of FIG. 1A.

Please refer to FIG. 1A and FIG. 1B, a fan 1 according to the first embodiment of the present invention includes an airflow guiding structure 10, an impeller 12 and a guiding ring 14.

The outer radius of the airflow guiding structure 10 increases gradually from the top of the airflow guiding structure 10 to the bottom of the airflow guiding structure 10, so that the outer surface of the airflow guiding structure 10 forms at least one curved surface. The impeller 12 is disposed over the airflow guiding structure 10. The impeller 12 has a hub 120 and a plurality of axial-flow blades 122 disposed around the hub 120. A motor (not shown) is disposed under the hub 120. The outer radius of the hub 120 increases gradually from the top of the hub 120 to the center of the hub 120. Preferably, a ratio of the outer radius of the bottom of the airflow guiding structure 10 to the outer radius of the bottom of the hub 120 ranges from 1.3 to 3.

The hub 120 includes an internal portion 1201, an external portion 1202, a hollow portion 1203 and a plurality of ribs 1204. The external portion 1202 is disposed around the internal portion 1201. The hollow portion 1203 is disposed between the internal portion 1201 and the external portion 1202. The ribs 1204 are disposed in the hollow portion 1203, and the ribs connect the internal portion 1201 and the external portion 1202. Therefore, airflows can pass through the hollow portion 1203, and heats generated by the motor disposed under the hub 120 can be dissipated.

The inner surface of the guiding ring 14 is connected with outer edges of the axial-flow blades 122. An inlet 141 is formed at the top of the guiding ring 14, and an outlet 142 is formed between the bottom of the guiding ring 14 and an outer surface of the sidewall of the airflow guiding structure 10. The diameter of the guiding ring 14 decreases gradually from the top of the guiding ring 14 to the top of the conjunction of the guiding ring 14 and the axial-flow blades 122, so as to guide more airflows into the fan 3 through the inlet 141. A first predetermined distance "Dx" is defined between the top of the guiding ring 14 and the top of the conjunction of the guiding ring 14 and the axial-flow blades 122. The conjunction of the axial-flow blades 122 and the hub 120 has a length "Dy". The ratio of "Dx" to "Dy" ranges from 0.3 to 1. The bottom of the guiding ring 14 is protruded and exceeding the bottom of outer edges of the axial-flow blades 122. A second predetermined distance "Dz" is defined between the bottom of the guiding ring 14 and the bottom of the outer edges of the axial-flow blades 122. The ratio of "Dz" to "Dy" ranges from 0 to 0.5. With regard to the external appearance, the fan 3 of the present invention can be classified as an axial-flow fan. When the motor drives the impeller 12 to rotate, the guiding ring 14 can be rotated as well as the impeller 12. At this time, the airflow enters the fan 3 from the inlet 141 and flows along the outer surface of the sidewall of the airflow guiding structure 10, and then exits the fan 3 through the outlet 142. Thus, the direction of the airflow passing through the outlet 142 is different from the direction of the airflow passing through the inlet 141. In the embodiment, the direction of the airflow entering the inlet 141 is roughly perpendicular to the direction of the airflow exiting from the outlet 142, this is similar to the conventional centrifugal fan. Furthermore, the shape of the airflow guiding structure 10 can minimize the air pressure loss while changing the airflow direction.

Figure 2A:
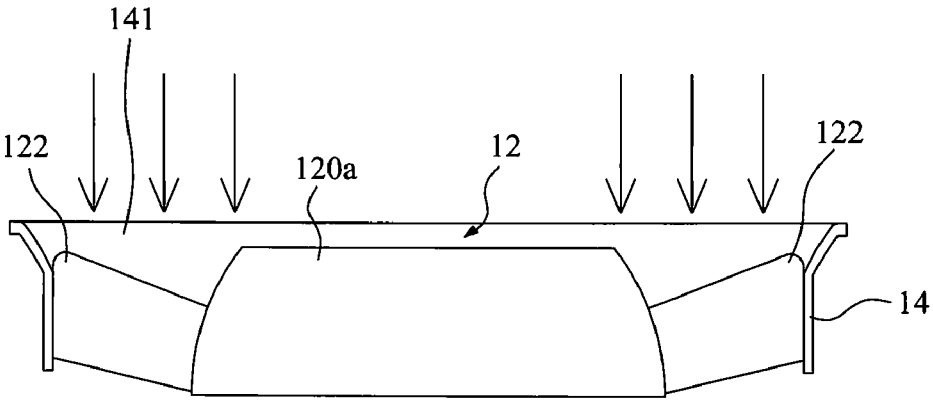
FIG. 2A and FIG. 2B show another two embodiments of the hub of FIG. 1A of the present invention.
Figure 2B:
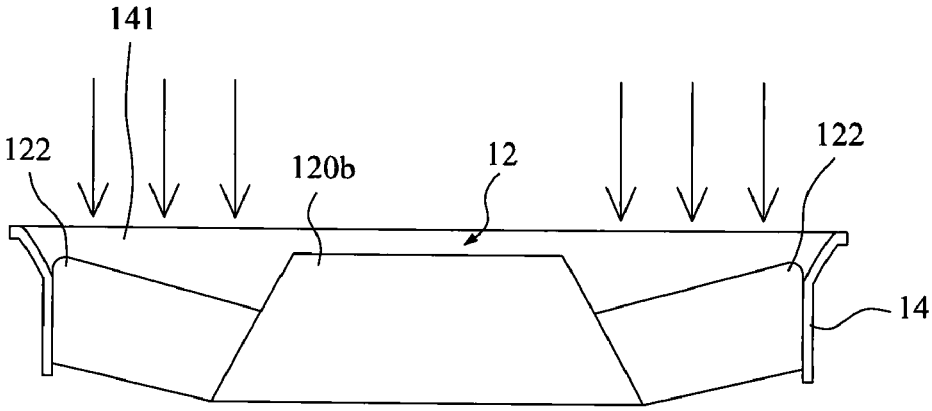

Please refer to FIG. 2A and FIG. 2B, which show another two embodiments of the hub of FIG. 1A of the present invention. The outer radius of the hub 120*a* of FIG. 2A increases gradually from the top of the hub 120*a* to the bottom of the hub 120*a*, so that the outer surface of the hub 120*a* forms at least one curved surface for guiding the airflow smoothly. The outer radius of the hub 120*b* of FIG. 2B increases gradually from the top of the hub 120*b* to the bottom of the hub 120*b*, so that the outer surface of the hub 120*b* forms at least one inclined surface.

Figure 2C:
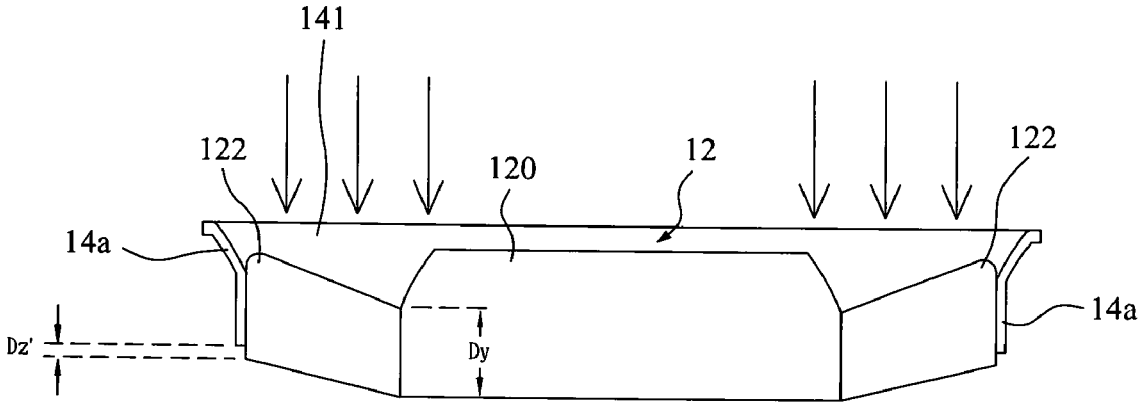
FIG. 2C shows another embodiment of the guiding ring of FIG. 1A of the present invention.

Please refer to FIG. 2C, which shows another embodiment of the guiding ring of FIG. 1A of the present invention. The bottom of the outer edges of the axial-flow blades 122 is protruded and exceeding the bottom of the guiding ring 14*a*. A third predetermined distance "Dz'" is defined between the bottom of the guiding ring 14*a* and the bottom of the outer edges of the axial-flow blades 122. The conjunction of the axial-flow blades 122 and the hub 120 has a length "Dy". The ratio of "Dz'" to "Dy" ranges from 0 to 0.5.

Figure 2D:
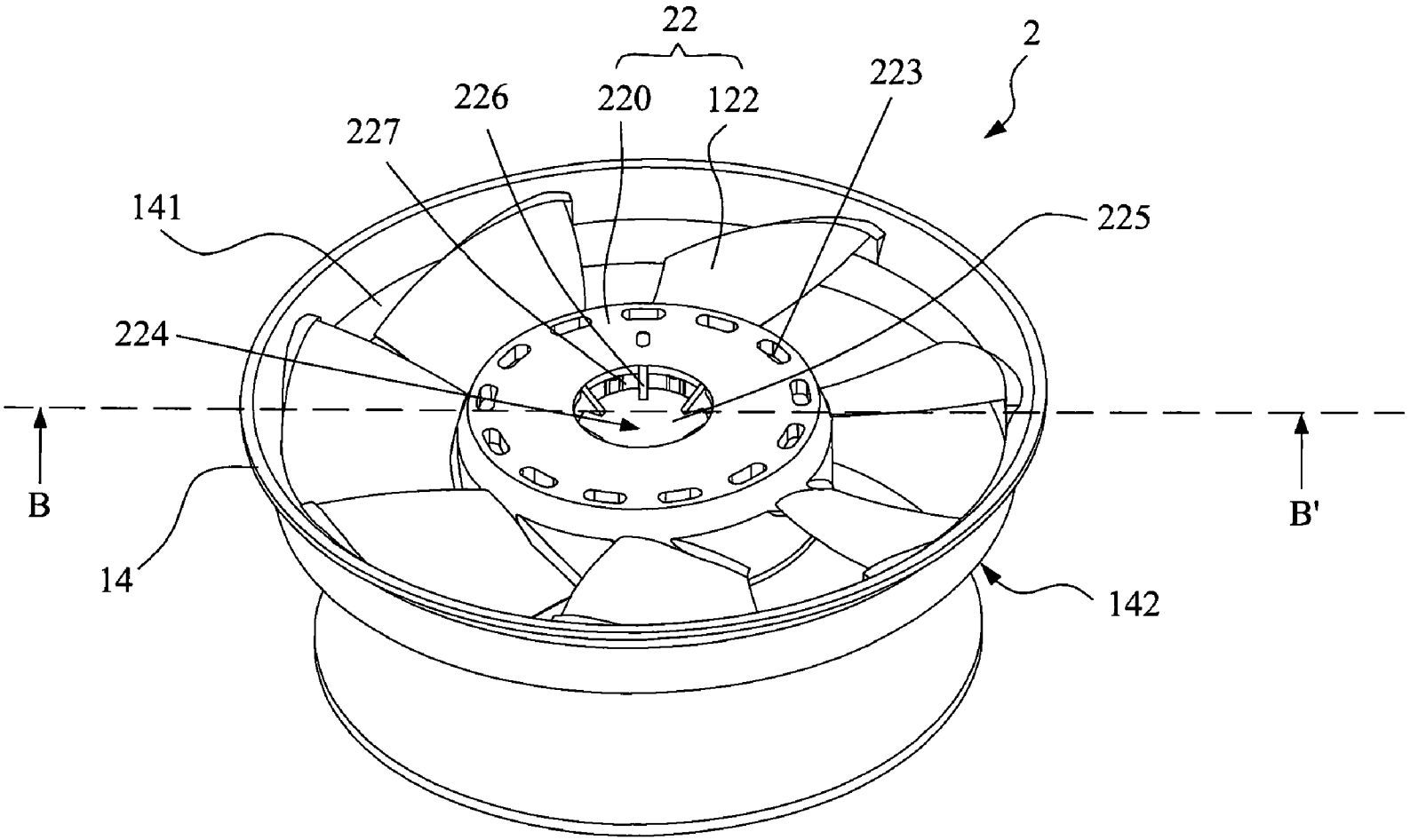
FIG. 2D is a three-dimensional illustration showing a fan according to a second embodiment of the present invention.

Please refer to FIG. 2D, which shows a fan 2 according to a second embodiment of the present invention. The difference between the fan 2 of the second embodiment of the present invention and the fan 1 of the first embodiment of the present invention is that the top surface of the hub 220 of the impeller 22 has a plurality of balance holes 223, so that when the rotation of the impeller 22 is imbalanced, a suitable number of balance materials can be placed in the balance holes 223 according to the rotation status of the impeller 22, so as to avoid the swing of the impeller 22 and make the impeller 22 to rotate stably.

Figure 3A:
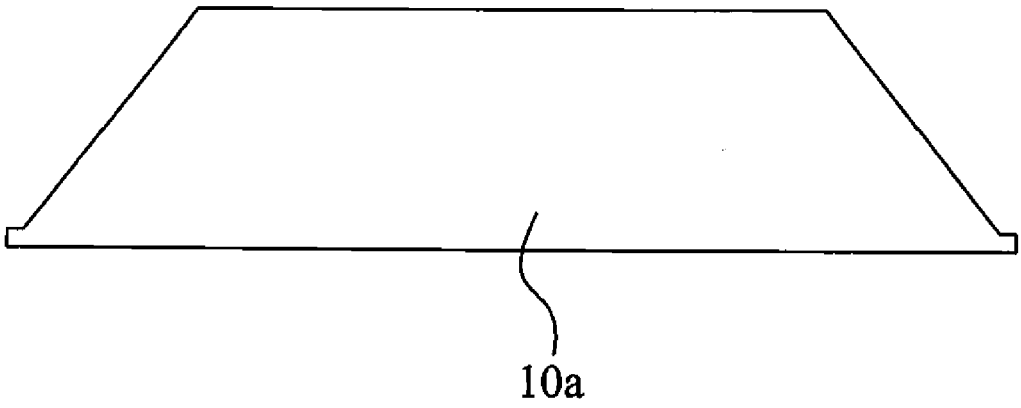
FIG. 3A and FIG. 3B show two embodiments of the airflow guiding structures of FIG. 2D of the present invention.
Figure 3B:
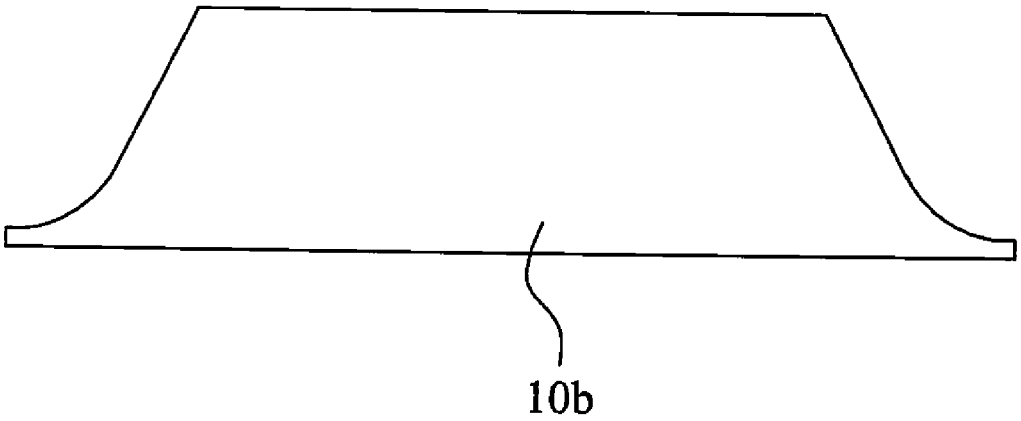

Furthermore, the hub 220 of the fan 2 has an intake 224 located at the center of the top surface of the hub 220. A base 225 and a plurality of ribs 226 are disposed in the intake 224, one end of each rib 226 are disposed around the edge of the intake 224 orderly, and another end of each rib 226 are connected with the base 225, so that the intake 224 is divided into a plurality of openings 227 (each opening 227 is formed between two adjacent ribs 226). Therefore, airflows can pass through the openings 227, and heats generated by the motor disposed under the hub 220 can be dissipated. Please refer to FIG. 3A and FIG. 3B, which show two embodiments of the airflow guiding structures of FIG. 2D of the present invention. The outer radius of the airflow guiding structure 10*a* of the second embodiment increases gradually from the top of the airflow guiding structure 10*a* to the bottom of the airflow guiding structure 10*a*, so that the outer surface of the airflow guiding structure 10*a* forms at least one inclined surface. The outer radius of the airflow guiding structure 10*b* of the third embodiment increases gradually from the top of the airflow guiding structure 10*b* to the bottom of the airflow guiding structure 10*b*, so that the outer surface of the airflow guiding structure 10*b* forms at least one inclined surface and at least one curved surface.

Figure 3C:
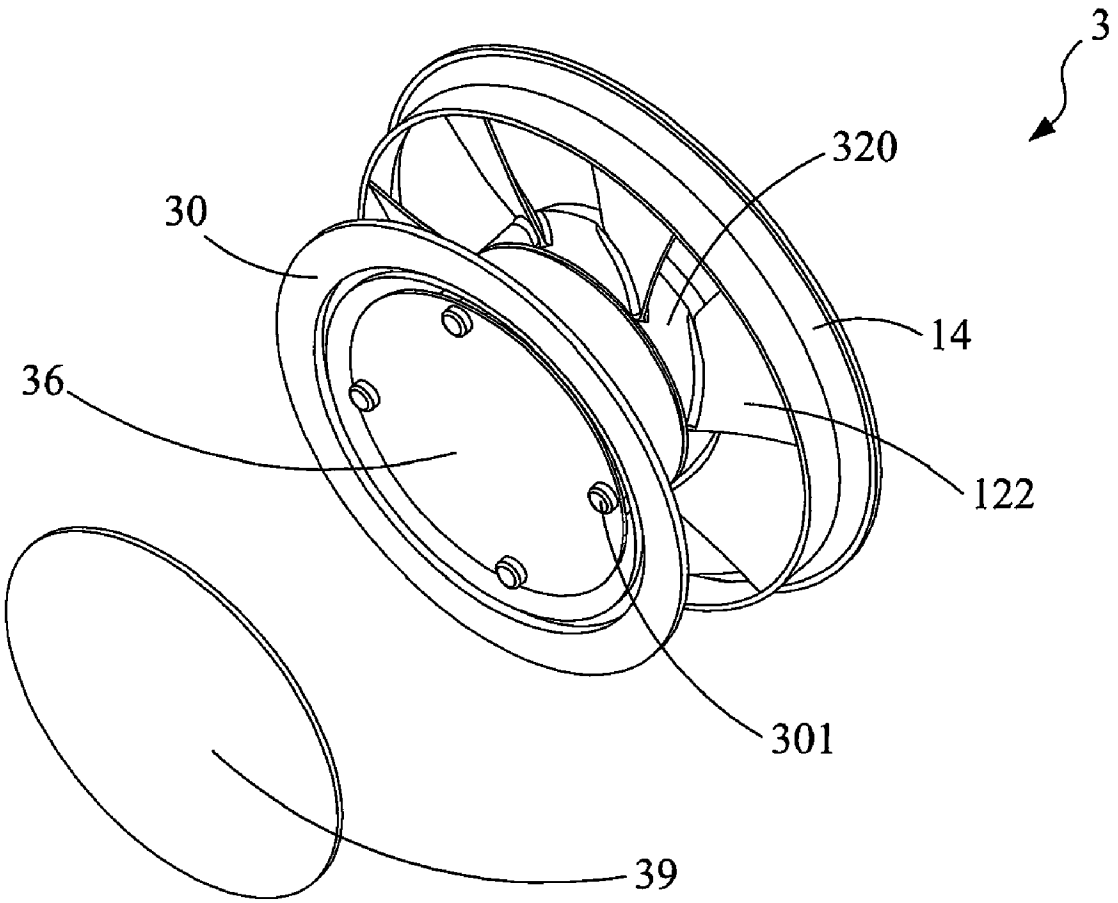
FIG. 3C is a three-dimensional illustration showing a fan according to a third embodiment of the present invention.
Figure 3D:
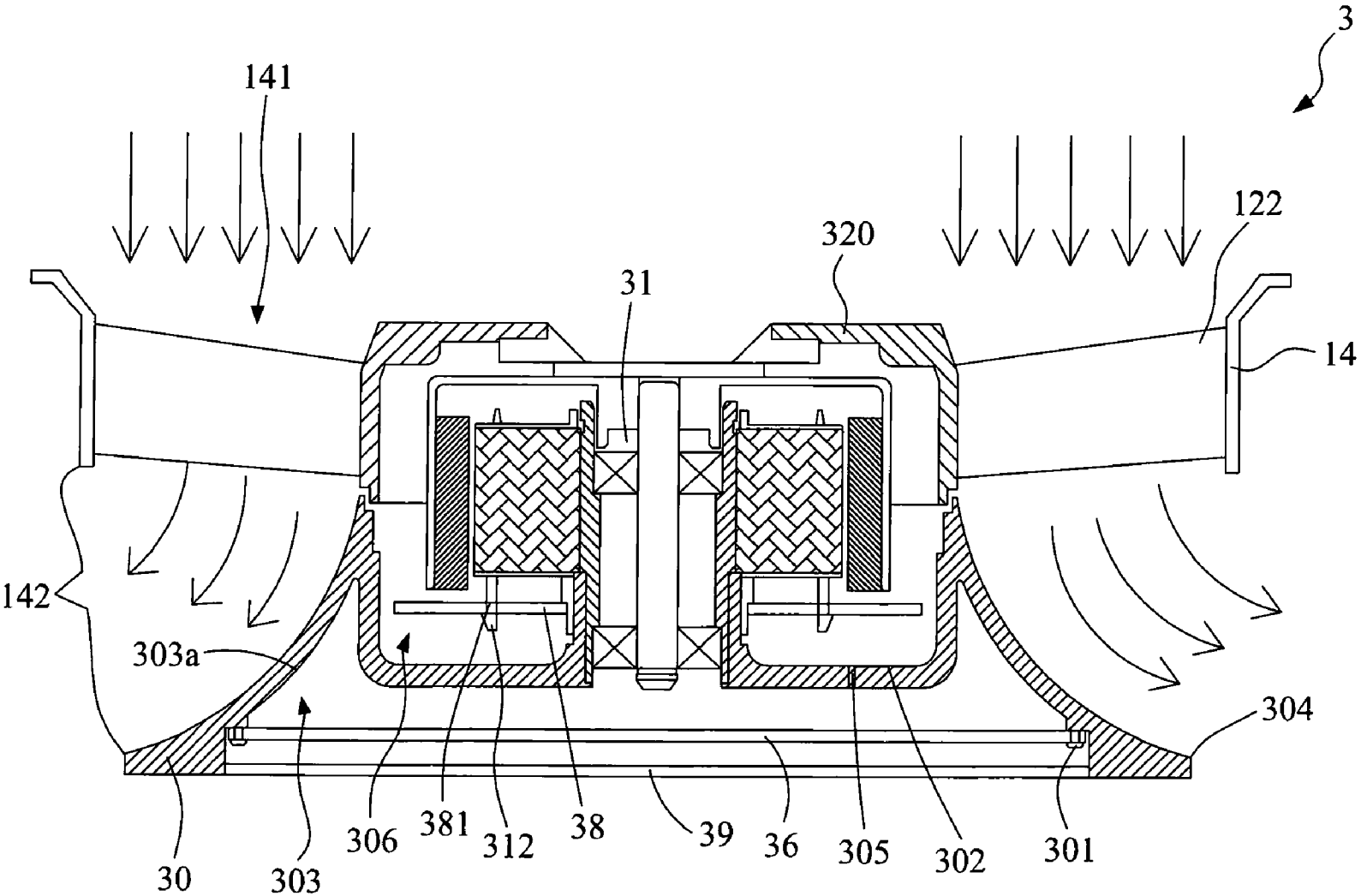
FIG. 3D is a sectional view of the fan of FIG. 3C.

Please refer to FIG. 3C and FIG. 3D, which show a fan 3 according to a third embodiment of the present invention. The difference between the fan 3 of the third embodiment of the present invention and the fan 1 of the first embodiment of the present invention is that the fan 3 further includes a first circuit device 36, a second circuit device 38 and a covering plate 39. A first space 303 is disposed in the airflow guiding structure 30 and close to the bottom 304 of the airflow guiding structure 30, so that the first circuit device 36 (an inverter, a controller, a rectification circuit, a controlling circuit or a motor driving circuit for example) which is supposed to be disposed outside the fan 3 can be fixed on an inner wall 303*a* of the first space 303 by at least a fixing element 301 (a screw, a rivet or other elements having the capability of fixing), so as to economize the use of space, and the first circuit device 36 can be protected under the airflow guiding structure 30.

Besides, the top surface 302 of the airflow guiding structure 30 has at least a through hole 305, so that the first circuit device 36 can be electrically connected with the second circuit device 38 or other element through the through hole 305. The covering plate 39 is connected with the bottom of the inner wall 303*a* of the first space 303 of the airflow guiding structure 30, thus the first circuit device 36 disposed in the first space 303 is hidden. In other embodiments, the first circuit device 36 can be fixed on the covering plate 39 by at least a fixing element.

The second circuit device 38 can be a circuit board in this embodiment, and a driving circuit is disposed on the circuit board for driving the motor 31 of the fan 3. A predetermined distance is formed between the bottom of the motor 31 and the top surface 302 of the airflow guiding structure 30, so that a second space 306 is formed between the motor 31 and the airflow guiding structure 30, and the second circuit device 38 is disposed in the second space 306. The circuit board (second circuit device 38) has at least a through hole 381 for connecting with a connecting part 312 of the stator of the motor 31. In other embodiments, the second circuit device 38 can be fixed on the motor 31 by at least a fixing element.

Figure 3E:
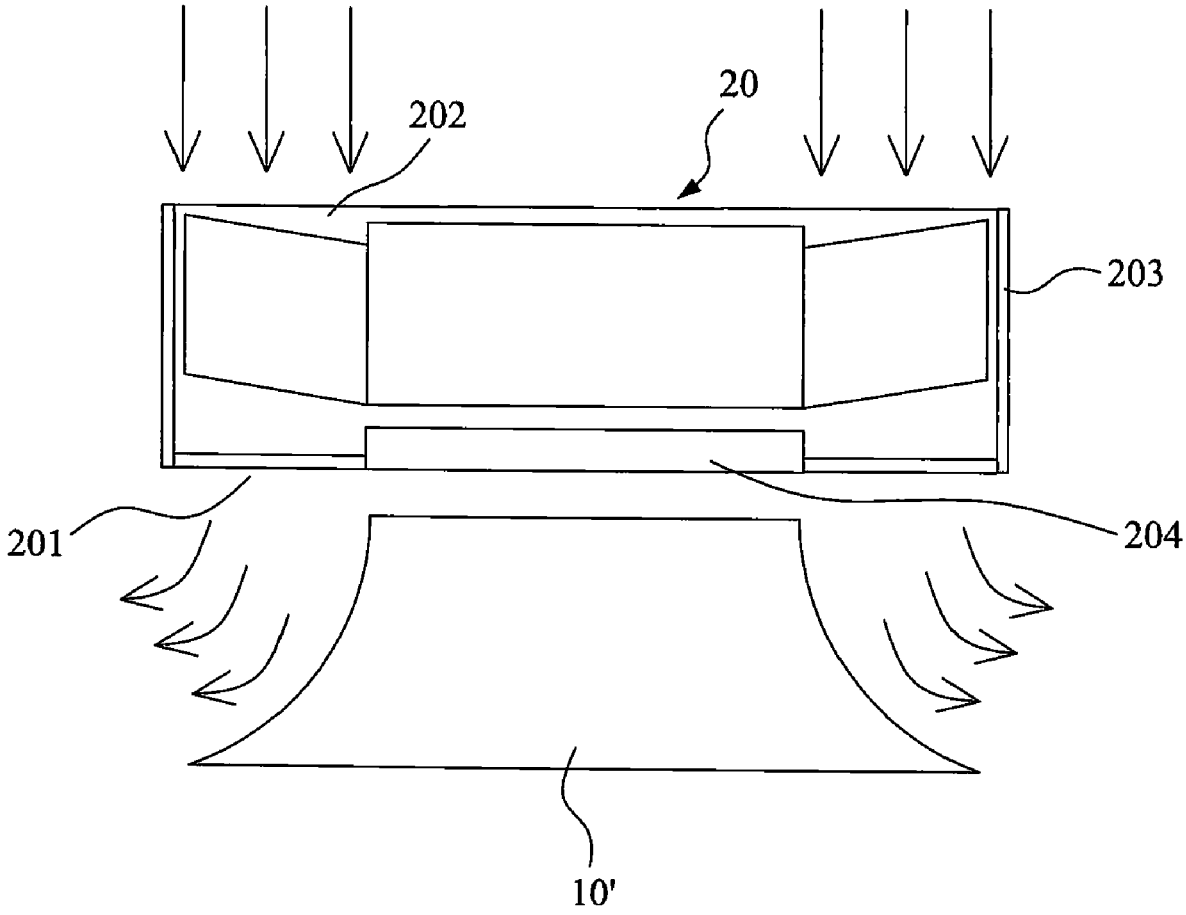
FIG. 3E is a sectional view showing the airflow guiding structure of the present invention applied to a conventional axial fan.

Please refer to FIG. 3E, which shows the airflow guiding structure 10' of the present invention applied to a conventional axial fan 20. The airflow guiding structure 10' is disposed underneath the outlet 201 of the axial-flow fan 20. The inlet 202 of the axial-flow fan 20 is arranged over the outlet 201. The outer radius of the airflow guiding structure 10' increases gradually from the top of the airflow guiding structure 10' to the bottom of the airflow guiding structure 10', so that the outer surface of the airflow guiding structure 10' forms at least one curved surface for changing the direction of the airflow exiting from the outlet 201 of the axial-flow fan 20. Preferably, the ratio of the outer radius of the bottom of the airflow guiding structure 10' to the outer radius of a fan frame 203 of the axial-flow fan 20 ranges from 0.9 to 2.5. To be noted, those skilled in the art should know that the airflow guiding structure 10' can be connected to the fan frame 203 or a base 204 of the axial-flow fan 20 by several connecting members. Alternatively, the airflow guiding structure 10' can also be connected to the connecting elements between the fan frame 203 and the base 204, or directly mounted on a module housing of a heat-dissipating target.

Figure 4A:
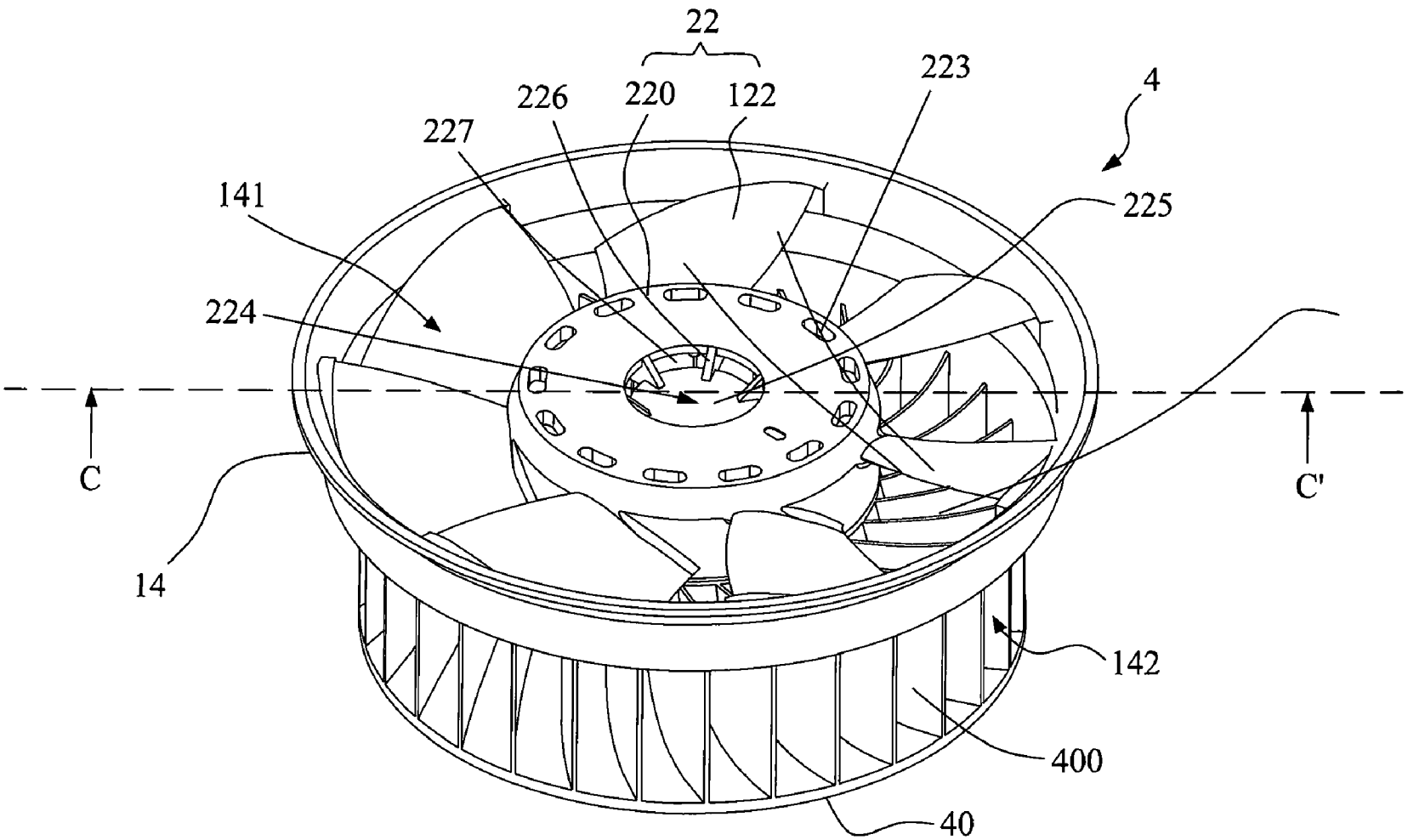
FIG. 4A is a three-dimensional illustration showing a fan according to a fourth embodiment of the present invention.
Figure 4B:
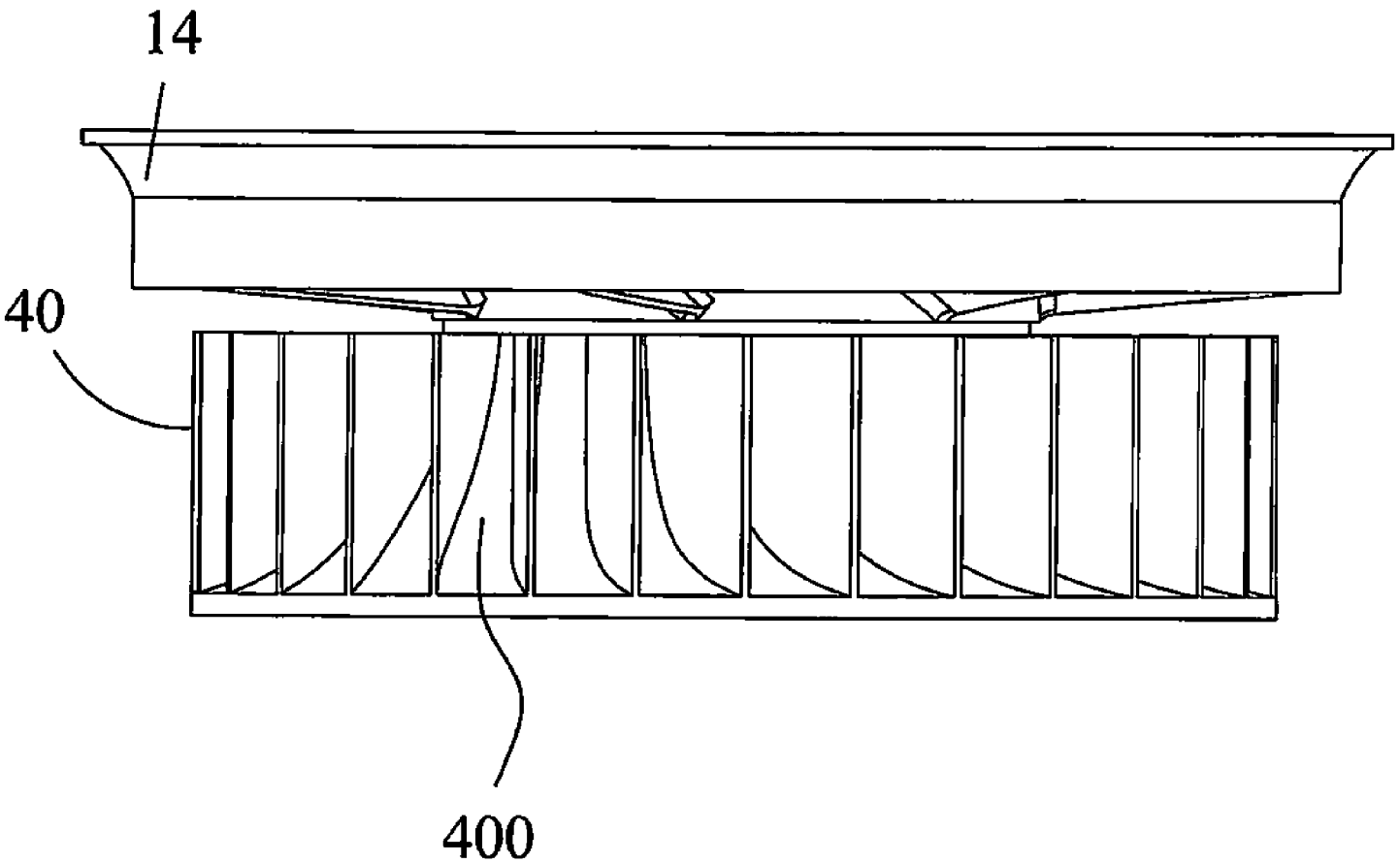
FIG. 4B is a lateral view of the fan of FIG. 4A.
Figure 5C:
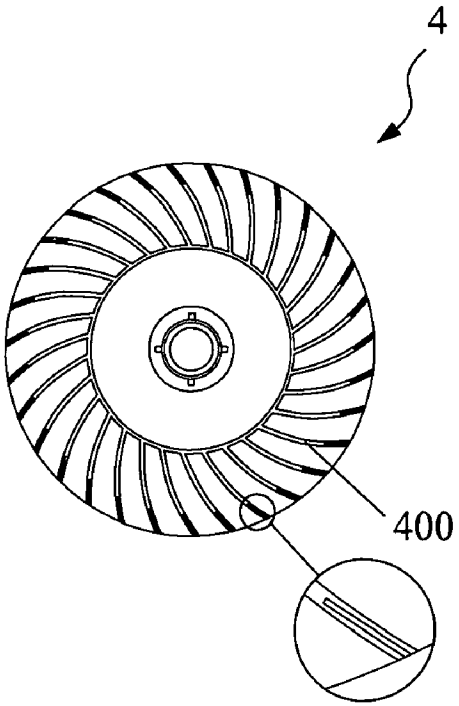
FIG. 5A to FIG. 5C are sectional views showing another three airflow guiding structures according to the present invention.
Figure 5B:
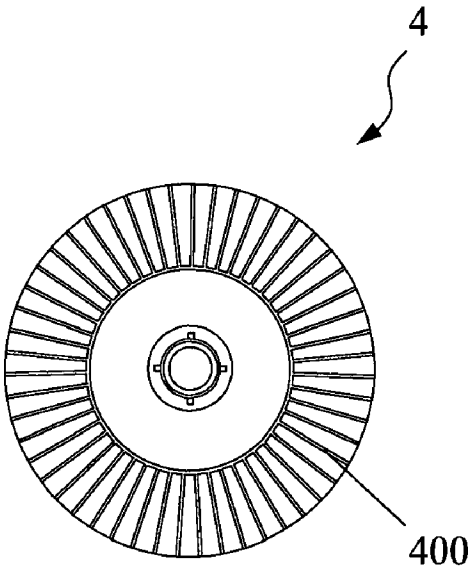
Figure 5A:
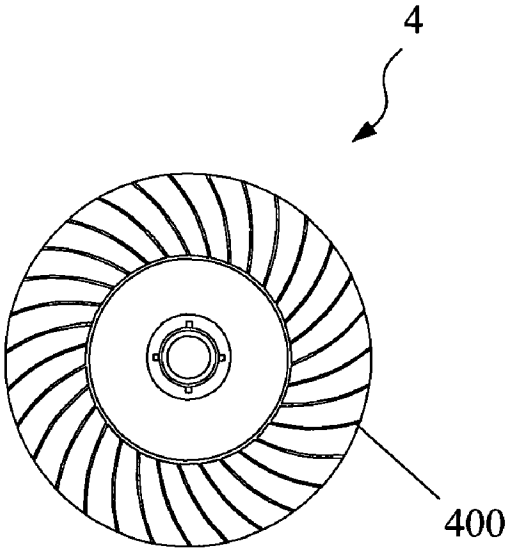

Please refer to FIG. 4A and FIG. 4B, which show a fan 4 according to a fourth embodiment of the present invention. The difference between the fan 4 of the fourth embodiment of the present invention and the fan 2 of the second embodiment of the present invention is that the airflow guiding structure 40 of the fan 4 is composed of a plurality of fins 400 which is made by metal (copper or aluminum for example). The fins 400 are arranged radially, i.e., the gap between two adjacent fins 400 increases gradually from the interior of the airflow guiding structure 40 to the outer edge of the airflow guiding structure 40, and the shape of each fin 400 can be curved or flat, as shown in FIG. 5A and FIG. 5B. Or, a claw portion can be disposed at the outer edge of each fin 400, as shown in FIG. 5C.

Figure 6A:
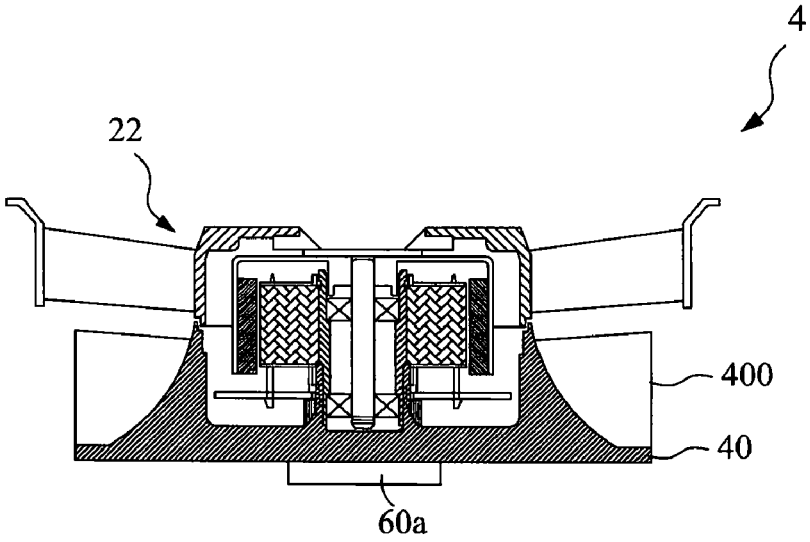
FIG. 6A is a sectional view of the fan along line C-C' of FIG. 4A applied to a heat source.
Figure 6B:
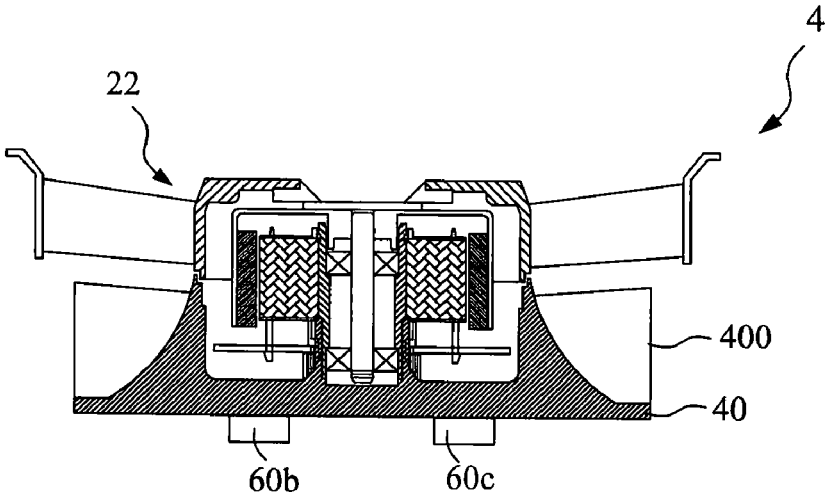
FIG. 6B shows the fan in FIG. 6A being applied to two heat source.

Please refer to FIG. 6A and FIG. 6B, FIG. 6A is a sectional view of the fan along line C-C' of FIG. 4A applied to a heat source, and FIG. 6B shows the fan in FIG. 6A being applied to two heat source. In FIG. 6A, the fan 4 is disposed on a heat source 60*a* (a CPU of a host of a computer or other electronic elements such as IC for example), and the bottom surface of the airflow guiding structure 40 is tightly connected with the heat source 60. Because the airflow guiding structure 40 is made of metal and the airflow guiding structure 40 of the fan 4 is composed of a plurality of fins 400, the heats generated by the heat source 60 can be conducted away from the heat source 60 through the airflow guiding structure 40 and its fins 400, then, the heats conducted to the fins 400 will be dissipated when the airflow generated by the rotation of the impeller 22 passes through the fins 400. Therefore, the airflow guiding structure 40 can not only change the direction of the airflow, but also has the capability of heat dissipation. Further, the fan 4 can be designed to meet practical requirements, such as for using onto more than one heat sources. As shown in FIG. 6B, the fan 4 can be disposed on two heat sources 60*b* and 60*c* for dissipating heats generated by these two heat sources 60*b* and 60*c*.

Figure 6C:
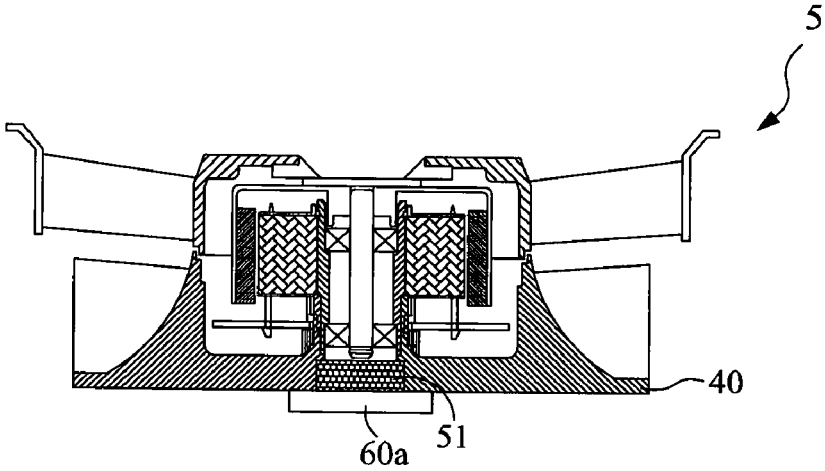
FIG. 6C shows a fan with the airflow guiding structure combined with a metal mass.

Furthermore, please refer to FIG. 6C, the difference between the fan 5 of the fan 4 of the FIG. 6A or FIG. 6B is that the center of the bottom of the airflow guiding structure 50 of the fan 5 is hollow, thus a metal mass 51, which is made of copper or aluminum, can be disposed in the airflow guiding structure 50 by hot plugging. The first step of hot plugging is to heat the airflow guiding structure 50 until the airflow guiding structure 50 at 300 degrees centigrade. Then, place the mass 51 into the expanded airflow guiding structure 50 and cool the airflow guiding structure 50 rapidly, so as to combine the mass 51 and the airflow guiding structure 50 tightly. After the mass 51 is combined in the airflow guiding structure 50, the bottom surface of the mass 51 is flush with the bottom surface of the airflow guiding structure 50, so that the bottom surface of the mass 51 can be tightly connected with the heat source 60.

In summary, the present invention can change the airflow direction of an axial-flow fan by the airflow guiding structure whose outer radius increases gradually from the top of the airflow guiding structure to the bottom of the airflow guiding structure. Furthermore, the present invention also keeps the advantages of the conventional axial-flow fan, such as low noise, large quantity of exiting airflow and high heat-dissipation efficiency. Moreover, the airflow guiding structure of the present invention can be composed of a plurality of fins which are made of metal, so that the airflow guiding structure also has the capability of heat dissipation. In addition, a first space is disposed in the airflow guiding structure and close to the bottom of the airflow guiding structure, so that a circuit device which is supposed to be disposed outside the fan can be disposed in the first space, so as to economize the use of space, and the circuit device can be protected by the airflow guiding structure.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

In summary, the present invention can change the airflow direction of an axial-flow fan by the airflow guiding structure whose outer radius increases gradually from the top of the airflow guiding structure to the bottom of the airflow guiding structure. Furthermore, the present invention also keeps the advantages of the conventional axial-flow fan, such as low noise, large quantity of exiting airflow and high heat-dissipation efficiency. Moreover, the airflow guiding structure of the present invention can be composed of a plurality of fins which are made of metal, so that the airflow guiding structure also has the capability of heat dissipation. In addition, a first space is disposed in the airflow guiding structure and close to the bottom of the airflow guiding structure, so that a circuit device which is supposed to be disposed outside the fan can be disposed in the first space, so as to economize the use of space, and the circuit device can be protected by the airflow guiding structure.

Although the present invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the present invention.

What is claimed is:

1. An airflow guiding structure, applied to a fan, the fan comprising an impeller, a circuit board, a motor and a guiding ring, the impeller having a hub and a plurality of axial-flow blades disposed around the hub, the guiding ring is connected with the axial-flow blades, wherein:

an outer radius of the airflow guiding structure increases gradually from a top of the airflow guiding structure to a bottom of the airflow guiding structure, an inlet is formed on a top of the guiding ring, and an outlet is formed between a bottom of the guiding ring and an outer surface of a sidewall of the airflow guiding structure, wherein a first predetermined distance is defined between the top of the guiding ring and the top of a conjunction of the guiding ring and the axial-flow blades, and a ratio of the first predetermined distance to the length of a conjunction of the axial-flow blades and the hub ranges from 0.3 to 1;

when the impeller rotates, an airflow enters the fan from the inlet and flows along the outer surface of the sidewall of the airflow guiding structure, then the airflow exits the fan through the outlet, and the direction of the airflow passing through the outlet is different from the direction of the airflow passing through the inlet;

wherein an inner surface of the guiding ring is connected with outer edges of the axial-flow blades, and the circuit board and at least a portion of the motor are disposed in an accommodating space formed inside the airflow guiding structure.

2. A fan, comprising:

an airflow guiding structure whose an outer radius increases gradually from a top of the airflow guiding structure to a bottom of the airflow guiding structure;

an impeller comprising a hub and a plurality of axial-flow blades disposed around the hub; and a motor disposed in the hub;

a circuit device for driving the motor; and a guiding ring connected with and surrounding the axial-flow blades, wherein an inlet is formed on a top of the guiding ring, and an outlet is formed between a bottom of the guiding ring and an outer surface of a sidewall of the airflow guiding structure; when the impeller rotates, an airflow enters the fan from the inlet and flows along the outer surface of the sidewall of the airflow guiding structure, then the airflow exits the fan through the outlet, and a direction of the airflow passing through the outlet is different from a direction of the airflow passing through the inlet, wherein a first predetermined distance is defined between the top of the guiding ring and the top of a conjunction of the guiding ring and the axial-flow blades, and a ratio of the first predetermined distance to the length of a conjunction of the axial-flow blades and the hub ranges from 0.3 to 1;

wherein an inner surface of the guiding ring is connected with outer edges of the axial-flow blades, and the circuit device and at least a portion of the motor are disposed in an accommodating space formed inside the airflow guiding structure.

3. The fan according to claim 2, wherein the direction of the airflow entering from the inlet is roughly perpendicular to the direction of the airflow exiting from the outlet.

4. The fan according to claim 2, wherein the outer surface of the airflow guiding structure forms at least one curved surface and/or at least one inclined surface.

5. The fan according to claim 1, wherein a diameter of the guiding ring decreases gradually from the top of the guiding ring to a top of the conjunction of the guiding ring and the axial-flow blades.

6. The fan according to claim 2, wherein the bottom of the guiding ring is protruded and exceeding a bottom of outer edges of the axial-flow blades; or a bottom of outer edges of the axial-flow blades is protruded and exceeding the bottom of the guiding ring.

7. The fan according to claim 6, wherein a second predetermined distance is defined between the bottom of the guiding ring and a bottom of the outer edges of the axial-flow blades, and a ratio of the second predetermined distance to the length of a conjunction of the axial-flow blades and the hub ranges from 0 to 0.5.

8. The fan according to claim 2, wherein an outer radius of the hub increases gradually from a top of the hub to a center of the hub, so that the outer surface of the hub forms at least one curved surface or at least one inclined surface; or an outer radius of the hub increases gradually from a top of the hub to a bottom of the hub, so that the outer surface of the hub forms at least one curved surface or at least one inclined surface.

9. The fan according to claim 8, wherein the bottom of the hub has a recess portion, and the top of the airflow guiding structure has a protruding portion disposed corresponding to the recess portion of the hub.

10. The fan according to claim 2, wherein a ratio of the outer radius of the bottom of the airflow guiding structure to the outer radius of a bottom of the hub ranges from 1.3 to 3.

11. The fan according to claim 2, wherein the airflow guiding structure further comprises a plurality of fins, and the fins are arranged radially.

12. The fan according to claim 11, wherein each of the fins comprises a curved surface or a claw portion, and a material of the airflow guiding structure comprises metal, copper or aluminum.

13. The fan according to claim 2, wherein the fan further comprises a mass disposed in the airflow guiding structure, and the mass is disposed in the center of the airflow guiding structure.

14. The fan according to claim 2, wherein the motor is disposed within the airflow guiding structure for driving the impeller to rotate and the motor comprises a bushing perpendicular to and connected with a top surface of the airflow guiding structure.

15. The fan according to claim 2, wherein the airflow guiding structure comprises a first space disposed in the airflow guiding structure, the circuit device is disposed in the first space of the airflow guiding structure, and the circuit device is a rectification circuit, a controlling circuit or a motor driving circuit.

16. The fan according to claim 15, wherein the fan further comprises a covering plate connected with a bottom of an inner wall of the first space of the airflow guiding structure, and the first circuit device is fixed on the covering plate by at least a fixing element.

17. A fan comprising:

an airflow guiding structure whose an outer radius increases from a top of the airflow guiding structure to a bottom of the airflow guiding structure;

an impeller comprising a hub and a plurality of axial-flow blades disposed around the hub; and a motor disposed in the hub;

a circuit board for driving the motor; and a guiding ring surrounding the axial-flow blades, wherein an inlet is formed on a top of the guiding ring, and an outlet is formed between a bottom of the guiding ring and an outer surface of a sidewall of the airflow guiding structure; when the impeller rotates, an airflow enters the fan from the inlet and flows along the outer surface of the sidewall of the airflow guiding structure, then the airflow exits the fan through the outlet, and a direction of the airflow passing through the outlet is different from a direction of the airflow passing through the inlet;

wherein the circuit board is enclosed within an accommodating space formed inside the airflow guiding structure via a covering plate connected with a bottom of the airflow guiding structure.

* * * * *